United States Patent [19]

Cicerone

[11] 4,324,094

[45] Apr. 13, 1982

[54] SEMIAUTOMATIC DEVICE FOR DOFFING SPOOLS FROM A SPINDLE BENCH

[75] Inventor: Aurelio Cicerone, Ronco Scrivia, Italy

[73] Assignee: Officine Savio S.p.A., Pordenone, Italy

[21] Appl. No.: 166,990

[22] Filed: Jul. 9, 1980

[30] Foreign Application Priority Data

Jul. 19, 1979 [IT] Italy ..... 68499 A/79

[51] Int. Cl.[3] ..... D01H 9/04

[52] U.S. Cl. ..... 57/267; 57/275

[58] Field of Search ..... 57/266, 267, 270, 275, 57/276

[56] References Cited

U.S. PATENT DOCUMENTS 3,344,593 10/1967 Morikawa et al. ..... 57/267

3,681,906 8/1972 Burgekmeister et al. ..... 57/270 X

FOREIGN PATENT DOCUMENTS 1072520 12/1959 Fed. Rep. of Germany .

2521057 1/1976 Fed. Rep. of Germany .

1509130 12/1967 France .

*Primary Examiner*—John Petrakes

*Attorney, Agent, or Firm*—Stevens, Davis, Miller & Mosher

[57] ABSTRACT

Device for the semiautomatic doffing of spools on cops provided with mushroom-shaped upper ends on a spindle bench in spinning with immovable closed or open flyers, characterized in that the bench upper plate has arms articulated thereto about vertical axes; the arms performing alternate angular movements in the horizontal plane with predetermined amplitude; the free end of each arm being provided with an immovable and open grip capable of penetrating into the volume of revolution of the corresponding flyer at the arrest of the spindle and coacting with the corresponding mushroom-shaped upper end of the cop following its rise to a predetermined height; a level R fixed to each pin, a rod pivotally connected to said levers to supply an alternating angular movement to the levers and means to lower the cops until there is a complete withdrawal of the spindles from the cops and the arms are rotatable in the opposite direction with respect to the previous rotation into the flyer's volume of revolution so as to take the spools out of the relative flyer's, and to conveniently accessibly position them ready for being removed.

4 Claims, 11 Drawing Figures

SEMIAUTOMATIC DEVICE FOR DOFFING SPOOLS FROM A SPINDLE BENCH it is known that when spinning on a spindle bench, spools are formed on tubes supported by rotating spindles on which are, in their turn, arranged rotating flyers.

It is also known that the higher spindle angular speed in relation to that of corresponding flyers governs the winding of the yarn on spools, while the flyer's absolute rotation determines its twist.

When a spool reaches the required dimensions it is doffed from the bench and replaced by an empty cop on which a new spool is consequently formed.

According to the actual prior art, the spindle bench may be equipped with movable or fixed flyers; the fixed flyers, being either closed or open.

In the case where the spindle bench is provided with movable flyers, during manual doffing, the flyers are manually, disengaged from the spindles by the operator, who subsequently removes the full spools, replacing them by empty cops and returning the flyers onto the spindle.

In the case where the spindle bench is provided with immovable flyers, closed or open, during the manual doffing a lowering of spindle carriage is imposed and, when the carriage reaches its lowest position, the operator takes off the spool from the relative spindle according to the following steps:

a movement from the bottom upwards, to disengage the spool from the spindle;

a lateral withdrawal of the spool from the working area;

and lastly the insertion of a new empty cop on the spindle.

In any case, the spool manual doffing operation is quite difficult for the operator, who is forced to work in a bent position to remove spools, which spools, due to their weight, require a certain effort, because of the difficulty of removing them from the corresponding spindles on which they are fitted with a minimum of clearance; and because of the limited maneuverability which is even more accentuated with immovable flyers, and particularly if it is of the closed type.

At the present state of the art of spindle benches, there are also two semiautomatic doffing systems; which systems can only be applied to benches with immovable flyers.

In one of the two aforesaid semiautomated systems it is necessary, at doffing, to lower the spindle carriage until the flyer central guide bars are withdrawn from the relative spool tubes and subsequently to remove the full spools, which are still supported on the carriage by means of the cop bases and to replace them by empty cops.

The semiautomatic doffing carried out according to these systems has nevertheless certain drawbacks.

To be specific in spindle benches with immovable flyer and with the semiautomatic doffing type, firstly mentioned herein above, the following has to be considered:

any imperfect positioning of even a single tube may cause crawling of the same over the guide bar of the corresponding flyer with subsequent serious mechanical damage;

it is necessary to adopt very tight tolerances for the coupling of the tube to the guide bar, so as to eliminate noise, vibration and lack of balance of the rotating parts; this requirement works against the need of having some clearance, which is demanded in the above mentioned coupling since each one of the two elements should have a finite velocity relative to the other.

As far as spindle benches with movable flyers are concerned and with the second kind of semiautomatic doffing mentioned above the following has to be considered:

the mechanisms proposed for executing the carriage alternate movement are loaded with the supplementary weight of the plate which intercepts the spools at doffing and which is idly carried up and down during the entire spool winding phase;

the complexity of the mechanisms which control the doffing plane increases the original cost of the assembly, as well as the maintenance cost of the same;

the contact between the doffing plate and spools may ruin the yarn's physical properties, as well as the package making; which package lies during taking up, directly on the corresponding support surface.

The difference in height between the carriage, when in the lowest position, and the spool bearing plate, does not correspond to the total withdrawal height of the spindle carried by the carriage, in relation to the spool tube. The spool therefore can be removed only by the lifting thereof at the beginning, which completes its withdrawal with respect to the spindle and, subsequently, horizontal translation must be imparted thereto.

The system can be only applied to benches with immovable flyers of the open type. An object of the present invention is to provide a doffing device that eliminates or at least considerably reduces the above mentioned drawbacks.

Another object of the invention is to provide a semiautomatic doffing device of spools on a spindle bench, simple of construction, reliable in operation and reduced in cost.

In view of the foregoing objects, the invention proposes a semiautomatic doffing device for spools on a spindle bench, particularly with an immovable flyer of the closed or open type, characterised by including angularly movable means, controlled by mechanical, pneumatic, electropneumatic or electromagnetic means or of any other suitable equipment-these angularly movable means being equipped with a terminal fork-each spool-and being able of inserting each fork into the volume of revolution pertinent to the corresponding flyer and to temporarily engage the mushroom-shaped end of the cop at the arrest of the flyer, and also raise the carriage which carries the spools beyond the normal required stroke in order to take the throat underlying the mushroom-shaped head of every cop to a position slightly higher than the bearing plate of the corresponding fork elements, engaging thus the corresponding cops of the spools, which remain suspended from the forks when, subsequently the carriage is lowered. The angularly movable devices, being lastly given an angular movement in the apposite direction with respect to the aforesaid one, with drawing the spools out of the relative flyers to an accessible position suitable for manual unloading of the same.

The invention will be better understood from the following description given by way of example with reference to the attached drawings, for merely illustrative purposes, in which.

Figure 10:
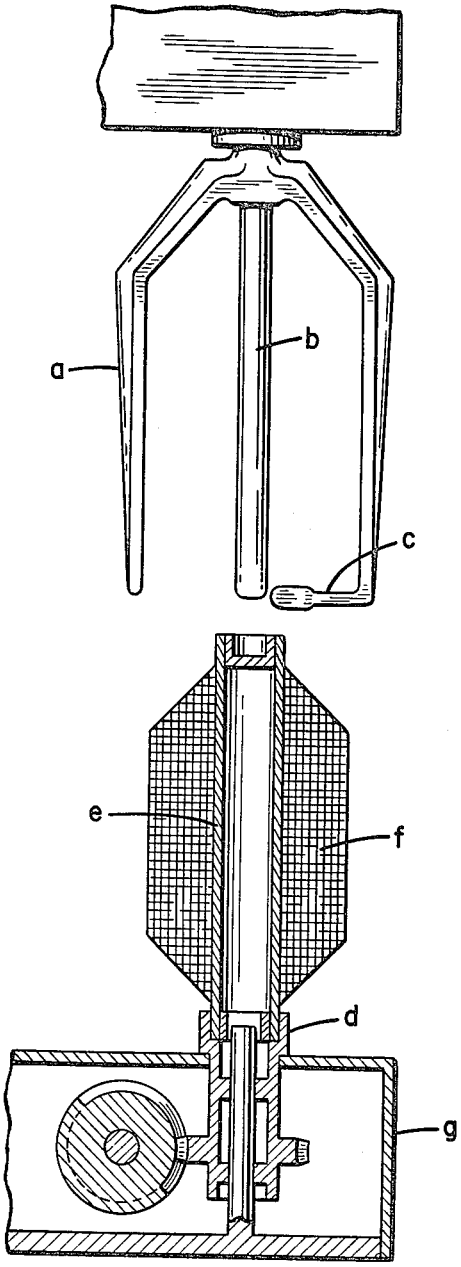
FIG. 10 PRIOR ART
Figure 11:
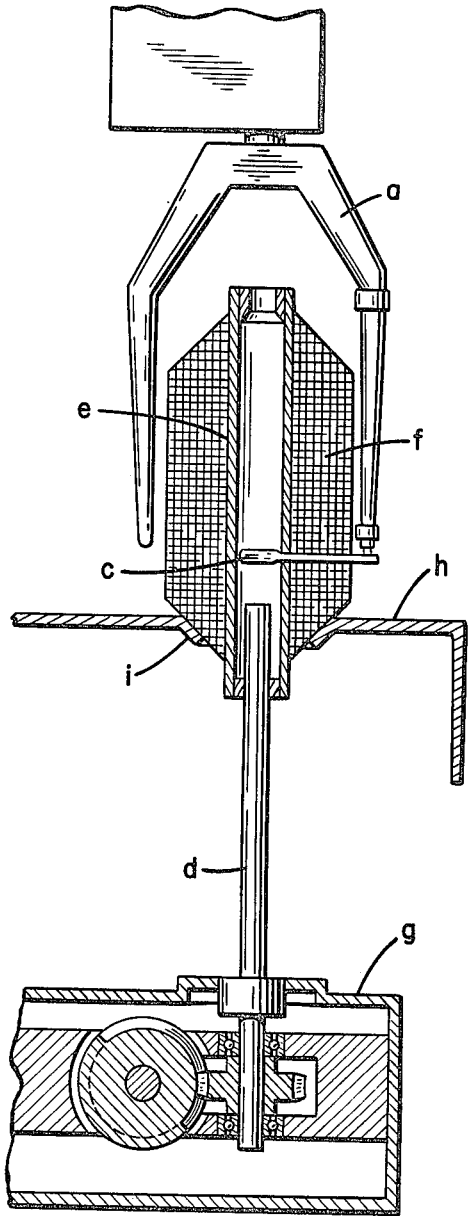
FIG. 11 PRIOR ART

FIGS. 10 and 11 schematically show two known semiautomatic removal systems.

With reference to FIG. 10, and as known, in a semiautomatic removal system on immovable flyer spindle benches indicated as (a), on guide bar (b) and on pressure finger (c), when spool (f) is completed on cop (e) arranged on spindle (d) completed, carriage (g) descends beyond the normal alternating vertical stroke limit and stops at the shown position. The operator then removes spool (f), by bending it to slightly lift it and displacing it sideways, taking care not to touch bar (b) when the spool is disengaged by the spindle; this operation is followed by an empty cop implacement on spindle (d).

In a second type of semiautomatic doffing with an immovable (a) flyer, FIG. 11, the lowering of the spindle carriage (g) beyond the normal stroke limit, after the completion of spool (f), subsequent to the stopping of plate (h), at such a height as to receive into a corresponding funnel-shaped seating (i) the lower conical part of spool (f) determining the partial withdrawal of the spools from relative spindles.

The yarn forming the package coming into contact with the edge of the seating, is subjected to pressure from the top to the bottom when the spindle (d) disengages from cop (e) and it may therefore be damaged.

Furthermore spindle (d) does not completely come out from cop (e), the removal of spool (f) therefore demands a limited lift and a further lateral movement.

According to the subject matter of the invention and with reference to FIGS. 5 to 9, a preferential but not limiting embodiment of the device, applied to closed flyers 12 of a spindle bench, provides that the upper end 14 of every cop of spool 13 is mushroom-shaped and between this end and the arched top of every flyer 12 there is provided a space which allows the passage of the end of a swinging arm 20 equipped with a terminal immovable grip 21.

Each arm 20 can execute an angular movement in a horizontal plane, about the vertical axis of a corresponding pin 17, which rotatingly traverses the upper plate 16 integral to the bench component. Each pin 17 is integral to a lever 18; which lever 18 is rotatingly pivoted with respect to a control rod 19, which can be given a longitudinal alternate movement by a mechanical, pneumatic or electropneumatic device, or any other suitable means.

Figure 5:
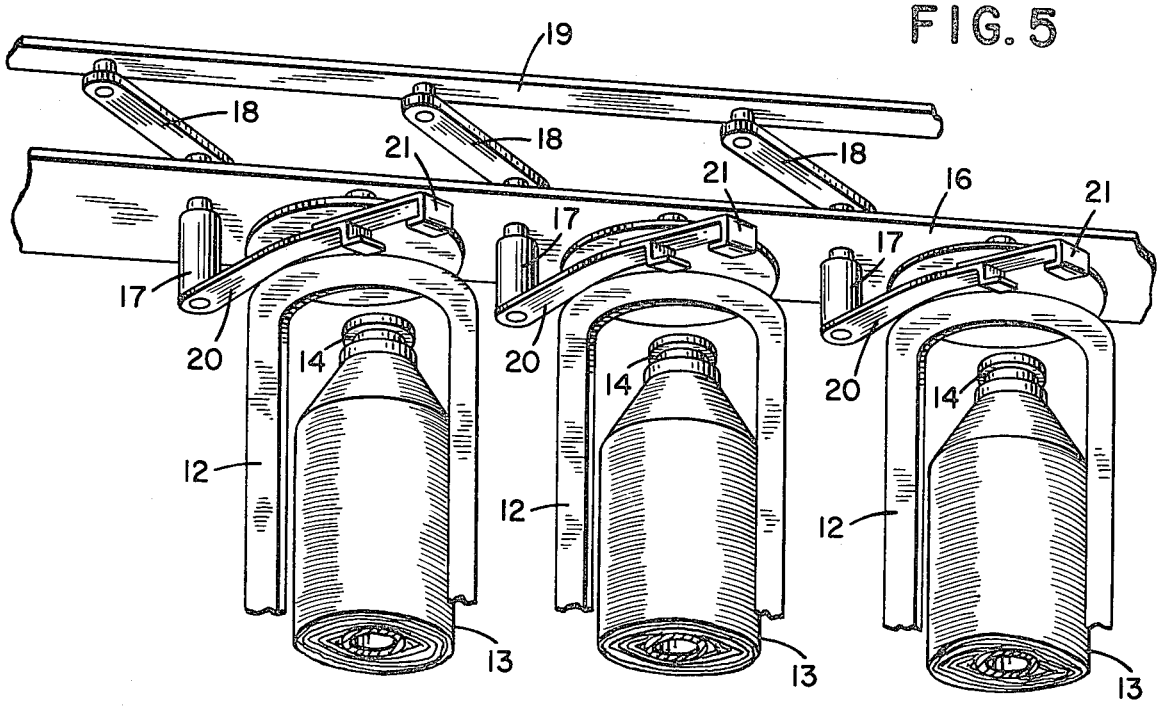
FIGS. 5, 6 and 7 are perspective views showing a simplified gripping means with the device for spool doffing.
Figure 6:
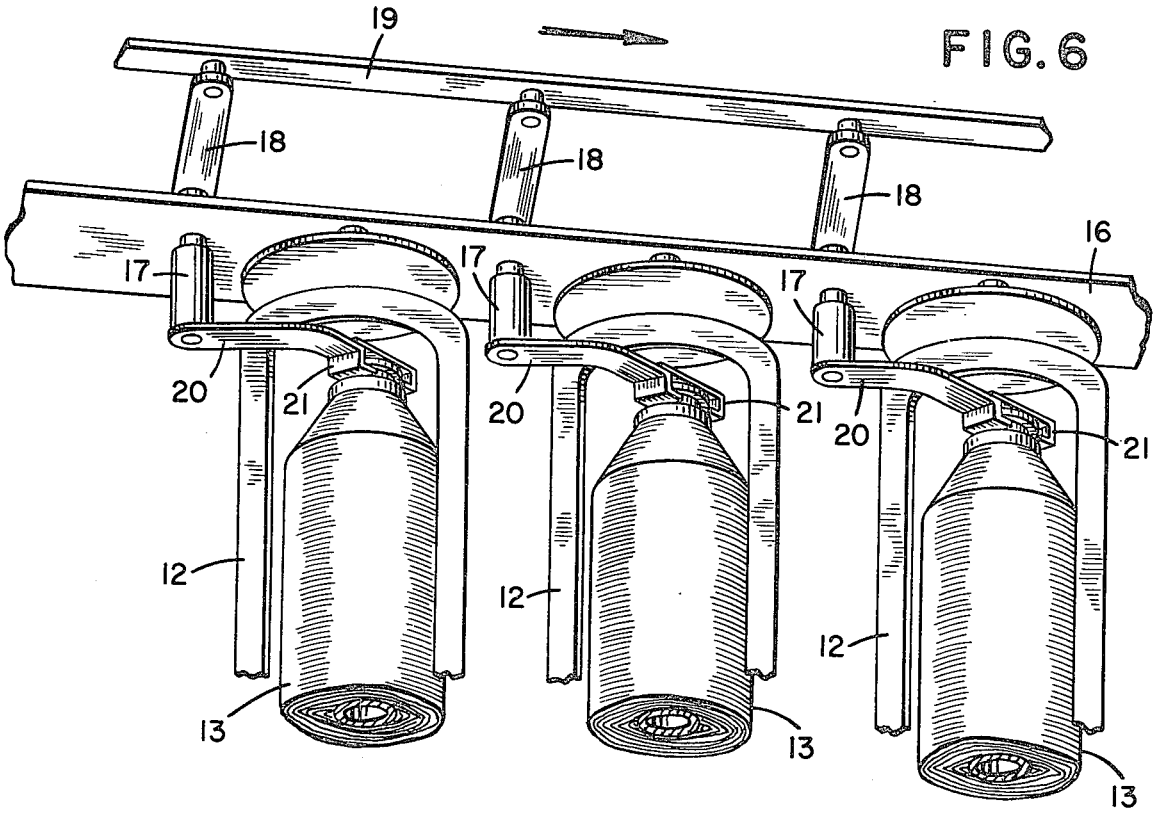
Figure 7:
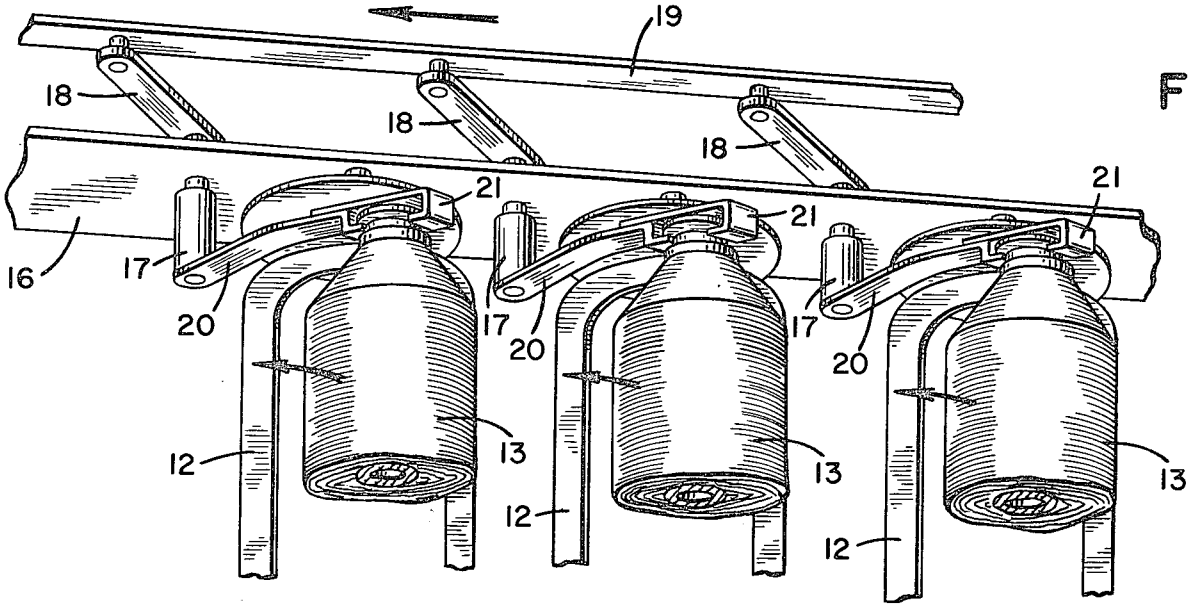
Figure 8:
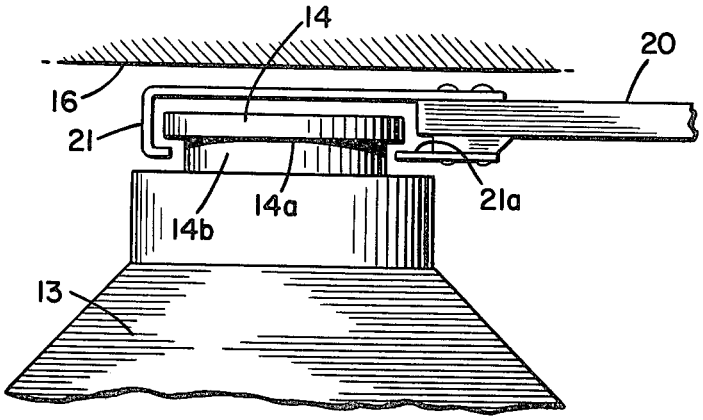
FIG. 8 is a partial side elevational view showing a spool upper end, the mushroom-shaped extremity of the tube engageable by the corresponding gripping element, according to FIGS. 5 to 7.
Figure 9:
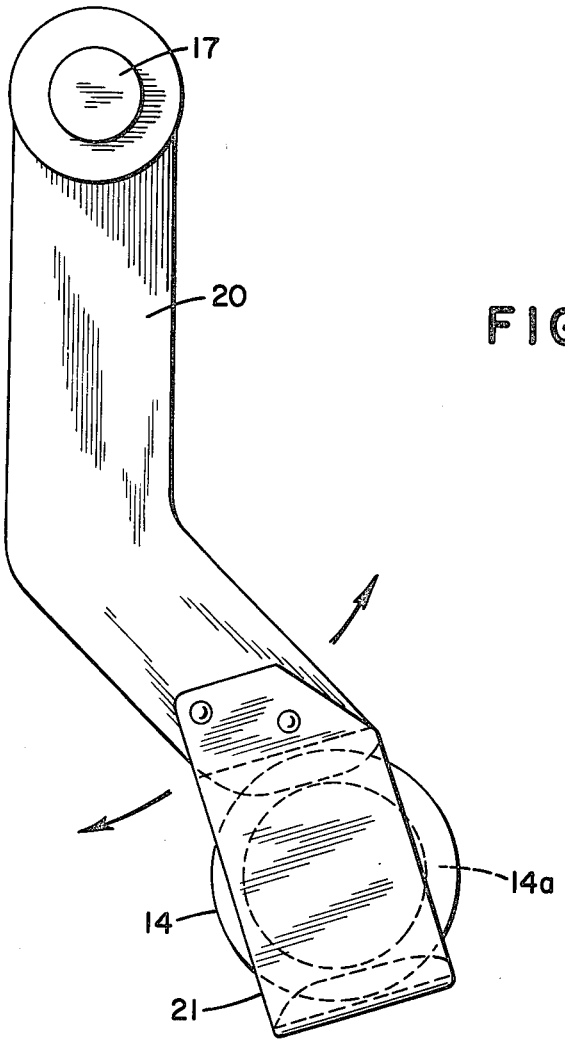
FIG. 9 is plan top view of one of the device's arms, in accordance with the variant shown in FIGS. 5 to 7.

Although for clarity's sake FIGS. 5 to 7 show only one row of flyers, each row is provided with a doffing device, the operation is as follows:

as flyers 12 with full spools 13 (FIG. 5) stop, the carriage lifts the spools 13 above the normally required stroke such that the lower edge 14*a* of each mushroom-shaped head 14 is taken to a slightly higher position in relation to the bearing plate 21*a* of the corresponding grip 21 (FIG. 8);

subsequently the front and rear levers 20 provided for the two rows of flyers, which are rotated by rod 19 and levers 18, with their ends projecting into the volume of revolution of the relative flyers 12, until as represented in FIGS. 5 and 8, engage the corresponding throats 14*b* of the mushroom-shaped heads 14;

the carriage descends again leaving the spools suspended from grips 21 of arms 20 (FIG. 6), the spools being freed from their relative spindles;

levers 18 and 20 relative to the bench front row are made to orbit by rod 19 in the opposite direction with respect to the aforesaid rotation thereby withdrawing the spools 13 out of the relative flyers (12), as illustrated in FIG. 7;

the operator manually and easily unloads now the spools 13, disengaging the mushroom-shaped heads 14 from grip 21;

once the unloading of the first row has taken place, the operator actuates levers 20 of the rear row, causing the exctraction of the second row of spools from the corresponding flyers 12, after which he proceeds to the removal thereof;

when the doffing operation is completed, the operator begins inserting empty cops on the spindles; and subsequently proceeds to knotting the yarn and preparing the bench for a new spinning cycle.

The above described semiautomatic doffing device whereby the operations of removing and unloading the spools making up the front and rear rows, are divided into two distinct phases, is due to the geometrical configuration of some spindle benches in which, because of the flyers arrangement, it is not possible to proceed to extract at the same time the spools of both rows. Regardless of that, if the spindle bench geometry permits it, it would be convenient to have a simultaneous extraction of the spools of both rows.

An alternative embodiment of the invention is schematically shown in FIGS. 1 to 4. According to this variant a lever arm 22, provided with longitudinal slot 23, is articulated in 24, to the end of lever 25, whose apposite end is articulated in 26 to a second lever 27, which is in its turn articulated in 28*a* to rod 28.

In slot 23 slides a block 30 connected to the end of lever 29, whose apposite end is pivoted in 31 to an articulated lever 32, that is pinned in 33*a* to a second rod 33, the rod 33 being parallel to rod 28.

Figure 4:
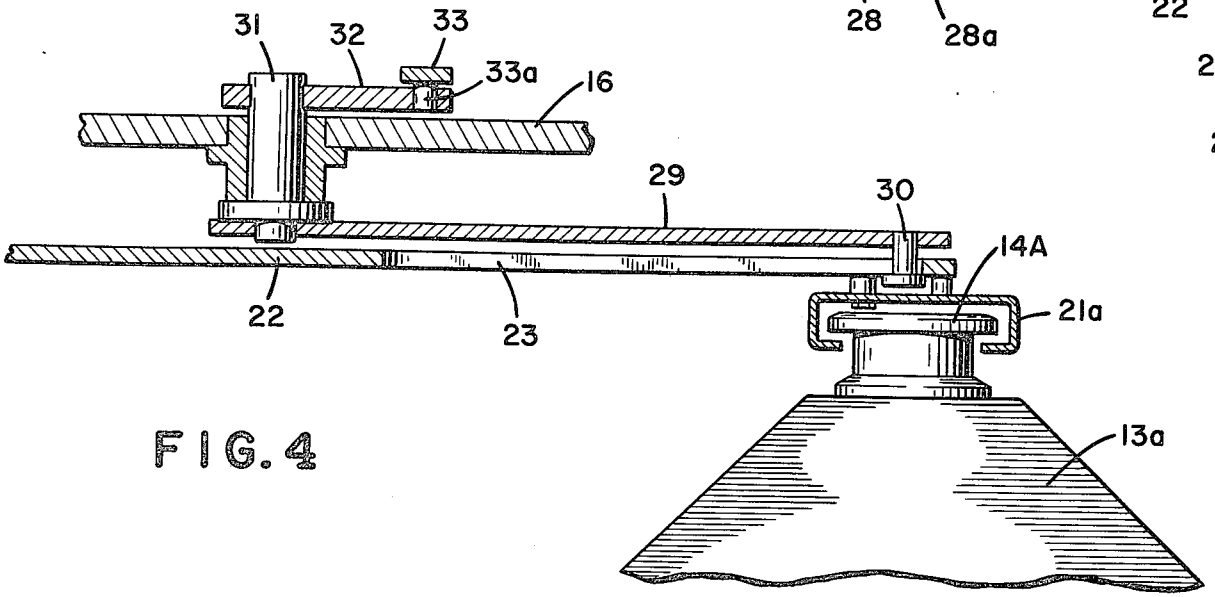
FIG. 4 is a vertical sectional view of the device along line IV—IV of FIG. 3.

With further reference to FIG. 4, the machine immovable structure is indicated by the numeral 16.

Figure 1:
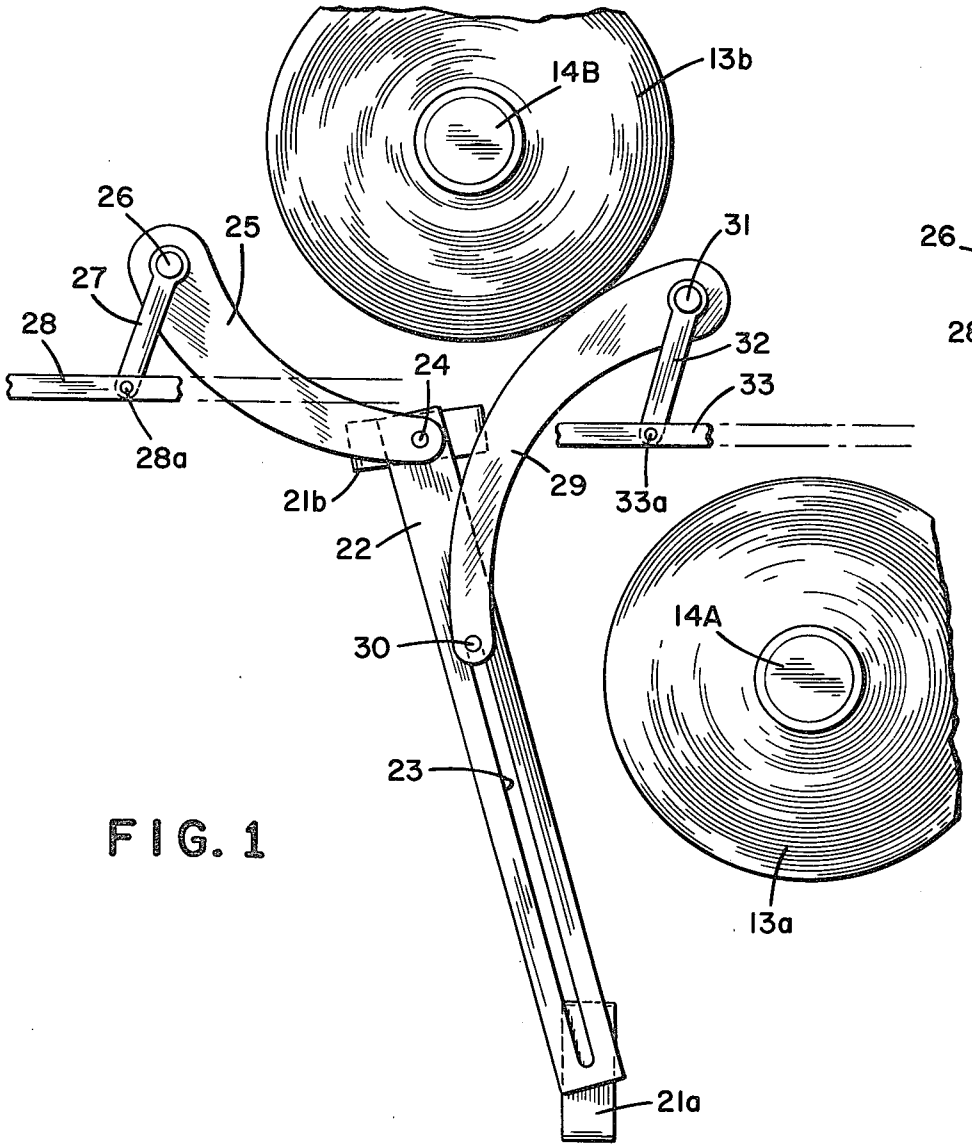

The operation of the second embodiment is as follows:

granted that when machine is at work the device linkage system is arrested at the position shown in FIG. 1 whereby 14*a*, 14*b* indicate the mushroom-shaped heads of the cop which are included in the first and in the second row of spools, at the moment of the machine's arrest for the doffing operation, a control (automatic or manual) lifts the carriages beyond the normal required stroke (as in the aforesaid embodiment) and then, by means of rod 28, levers 25 of the rear side are rotated, so as to enter their relative flyers (not shown) and engage grip 21*b* to the mushroom-shaped head 14*b* of the relative spools 13*b*, immediately afterwards comes the movement of the front levers 29, which, through the sliding of link 30 inside the slot 23 of the relevant lever 22, causes the gripping means 21*a* to engage their relative mushroom-shaped heads 14*a* of the cops of the front row spools. With the rear and front spools engaged by the gripping means 21*a*, 21*b*, the carriage starts to descend. When the spindles are completely freed from their spools 13*a*, 13*b*, the front levers 29 return to their rest position, and then the rear levers 25 too assume this position, through the action of the corresponding rods 33, 28. The spools are therefore suspended from the gripping means 21*a*, 21*b* which are positioned exactly as in FIG. 1. At this point spools 14*b* of rear row, as well as spools 14*a* of the front row are ready for withdrawal by the operator.

As can be clearly seen from FIGS. 1 to 4, the gripping means 21*a*, 21*b* are fixed to lever 22, instead of being fixed to levers 25, 29.

Figure 2:
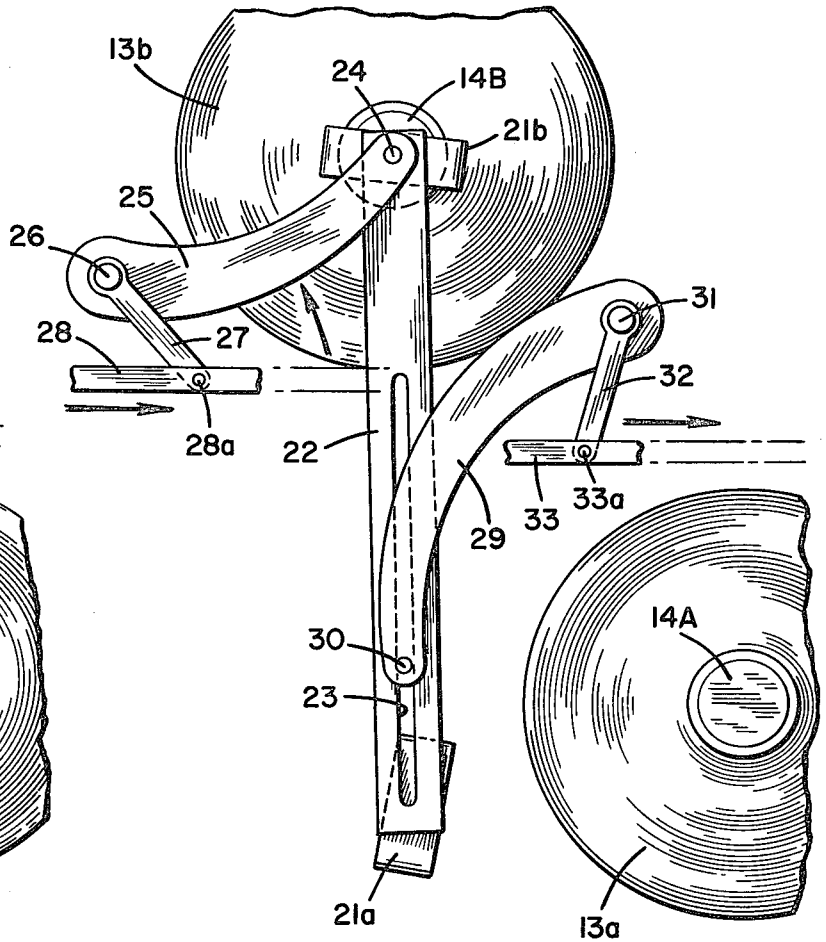
FIGS. 1, 2 and 3 are top plan views, schematically showing three different stages of a device with interlocked levers, according to the subject-matter of the present invention and which is able to carry out the spool doffing on a bench including two parallel rows of spindles.
Figure 3:
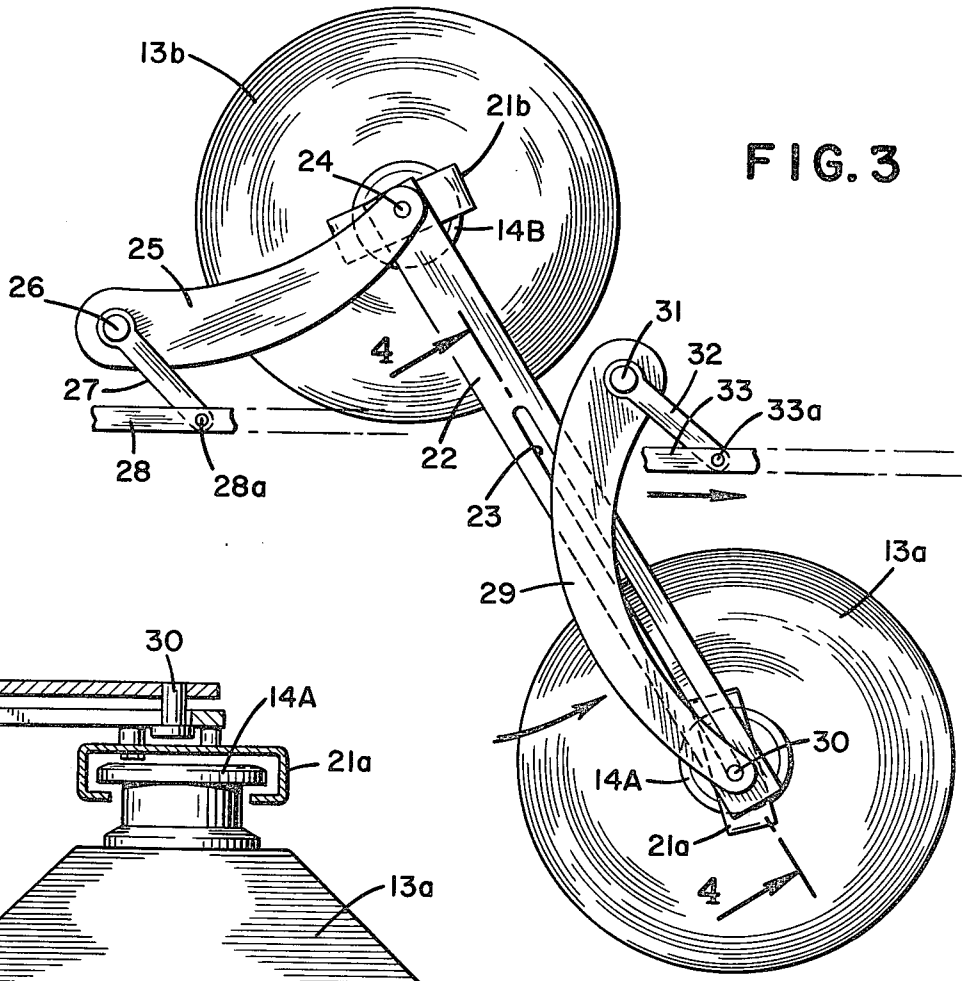

The phases of the device operation of FIGS. 1–4 are as follows-rest position, FIG. 1 insertion of levers 25 inside the rear row flyers, while the front levers 29 and levers 22 take the position shown in FIG. 2;

insertion of levers 29 and the ends of levers 22 into the corresponding flyers of the front row, FIG. 3;

the lowering of the carriages and the release of the cops from the spools of both front and rear row;

exit of the front levers 29 from the front row flyers;

exit of the rear levers 25 from the rear row flyers, subsequent removal of spools 13*a*, 13*b* and the introduction of a new working cycle.

The control of lever 29 is operated by a rod 33 on the side of the front row, and by a second rod 28 on the rear row; these rods are in turn given a translational movement by two pneumatic cylinders (for instance) and they are longitudinally arranged frontally to the machine.

This translational movement is transformed into a rotational movement of levers 25 and 29 thanks to the pivoting of these rods to linkages 27, 32 articulated in 26, 28*a* and 31, 33*a*, respectively to the corresponding rods 28, 33.

As shown in the right handside view of the detail of FIG. 4 the carriage raises the spools to such a height, that the mushroom-shaped heads 14 (FIGS. 5, 6, 7) or 14*a*, 14*b* (FIGS. 1 to 4) are raised to such a level that they allow an easy entry, without friction, of grips 21-21*a*-21*b*, into throats 14*b* (FIG. 8) of the mushroom-shaped heads of the cops which support the formed spools 13. The consequent lowering of the carriages governs the retaining of the mushroom-shaped heads 14, as shown on the left in a sectional view in the same FIG. 4 and the consequent spindle withdrawal from the corresponding cops, which with their relative spools 13, remain suspended on grips 21, ready to be removed manually.

From the foregoing description the features of the invention appear evident; but the embodiments shown and described should not be construed in the limitive sense and should include any analogous or equivalent solution.

I claim:

1. Device for the semiautomatic doffing of at least one row of spools on cops provided with mushroom-shaped upper ends on a spindle bench in spinning with immovable closed or open flyers, comprising a horizontal bench upper plate; a plurality of vertical pins rotatingly traversing said plate; an arm having a free end fixed to each of said pins; said arms performing alternate angular movements in the horizontal plane with predetermined amplitude; an immovable and open grip positioned on the free end of each of said arms capable of penetrating into a volume of revolution of a corresponding flyer at the arrest of said spindle and coactable with the corresponding mushroom-shaped upper end of the cop following its rise to a predetermined height; a lever fixed to each pin; a rod pivotally connected to said levers to supply an alternating angular movement to said levers; and means to lower the cops until there is a complete withdrawal of the spindles from the cops, and the aforesaid arms are rotatable in an opposite direction with respect to the previous rotation into the flyer's volume of revolution so as to take the spools out of the relative flyers, and to conveniently accessibly position them ready for being removed.

2. The device for semiautomatic doffing according to claim 1 including two parallel rods each pivotally connected to levers of one row of spools and drive means which are able to perform alternate translation movements to said rods.

3. The doffing device of claim 2 wherein one of said rods for performing alternate translational movements for spools of one row is pivotally connected to an end of a first connecting lever whose opposite end is fixed to an end of a first arm and the other of said rods for performing alternate translational movement for spools of another row is pivotally connected to an end of a second connecting lever whose opposite end is fixed to an end of a second arm and including a third arm having two ends and a longitudinal slot therein, a sliding pin within said slot integral with the other end of said second arm and grips mounted on opposite ends of said third arm insertable into the volume of revolution of the flyers in different rows to engage the mushroom-shaped upper ends of the cops, the other end of said first arm being pivotally connected to an end of said third arm.

4. A device according to one of claims 1, 2 or 3 wherein said grips cooperating with the mushroom-shaped upper end of the cop is a stiff open jaw, with a substantially rectangular profile.

* * * * *